US005105613A

United States Patent [19]

Zott et al.

[11] Patent Number: 5,105,613

[45] Date of Patent: Apr. 21, 1992

[54] ARRANGEMENT FOR THE INTERMEDIATE STORAGE OF A DOUBLE YARN

[75] Inventors: Werner Zott, Donzdorf; Winfried Joos, Königsbronn-Zang, both of Fed. Rep. of Germany

[73] Assignees: Hans Stahlecker; Fritz Stahlecker, both of Fed. Rep. of Germany

[21] Appl. No.: 492,062

[22] Filed: Mar. 12, 1990

[30] Foreign Application Priority Data

Mar. 15, 1989 [DE] Fed. Rep. of Germany ..... 3908463

[51] Int. Cl.[5] ..... D01N 15/00

[52] U.S. Cl. ..... 57/261; 57/22; 57/264; 57/333

[58] Field of Search ..... 28/141, 272; 57/22, 57/261, 264, 333, 352

[56] References Cited

U.S. PATENT DOCUMENTS 3,443,292 5/1969 Davis ..... 28/272
4,121,409 10/1978 Uchida et al. ..... 57/22
4,223,517 8/1980 Husges et al. ..... 57/263 X
4,646,513 3/1987 Briner et al. ..... 57/263
4,833,874 8/1989 Stanlecker et al. ..... 57/22 X
4,845,936 7/1989 Artzt et al. ..... 57/261
4,944,145 7/1990 Stahlecker ..... 57/264 X
4,953,800 9/1990 Okubo et al. ..... 242/45
4,958,486 9/1990 Stanlecker ..... 57/261
4,964,268 10/1990 Stahlecker ..... 57/261
4,967,549 11/1990 Lovas et al. ..... 242/35.5 R X

FOREIGN PATENT DOCUMENTS 3611505 10/1987 Fed. Rep. of Germany .

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In the case of an arrangement for the intermediate storage of a double yarn formed of two yarn components, a suction chamber is provided which has an air permeable depositing surface for the double yarn. In addition, an air nozzle is provided at the inlet side of the suction chamber which receives the double yarn and delivers it to the suction chamber.

16 Claims, 1 Drawing Sheet

A
B
C
D
E
1
2
3
4
5
6
7
8
9
10
11
12
14
16
17
18
19
20
21
22
23
24
25
26
27
28
29
30
31
32
33
34
35
36
37

ARRANGEMENT FOR THE INTERMEDIATE STORAGE OF A DOUBLE YARN

BACKGROUND AND SUMMARY OF THE INVENTION

The invention relates to an arrangement for the intermediate storage of a double yarn formed of two yarn components which is arranged between a delivery device and a yarn connecting device and which, during the establishing of a connection between the double yarn delivered by the delivery device and a yarn taken from a wind-up spool, receives the continuously delivered yarn length in a suction chamber.

In a known arrangement of the initially mentioned type (DE-A 36 11 505), a suction chamber is provided which receives, in the shape of a loop, the double yarn delivered continuously during the establishing of a yarn connection. It was found that at very high delivery speeds, a relatively large yarn length must be stored intermediately which requires a very long suction chamber for which the available space is frequently not sufficient.

In commonly assigned U.S. patent application Ser. No. 350,520, filed May 11, 1989, now U.S. Pat. No. 4,958,486, Sep. 25, 1990 corresponding to German Patent Application (P 38 17 222.4), which is not a prior publication, an arrangement is disclosed for the intermediate storage in which the the suction chamber has an air permeable depositing surface for the double yarn so that this double yarn can be deposited in loop shapes on top of one another, which may be called a "semirandom" storage.

During the intermediate storing of double yarns, particularly of double yarns which are formed of two essentially untwisted yarn components which are only prestrengthened by means of pneumatic false-twist spinning, there is the additional risk that disturbances occur as a result of the fact that the two yarn components shift with respect to one another so that undesirable yarn loops are formed in the individual yarn components. There is the danger that yarn loops of this type do not open up completely when the double yarn is withdrawn from the intermediate storage device so that disturbances may occur.

The invention is based on the object of providing an arrangement of the initially mentioned type in which, on the one hand, a relatively large length of a double yarn can be stored intermediately and in which, on the other hand, it is securely prevented that the yarn components of the double yarn shift with respect to one another.

This object is achieved in that the suction chamber has an air permeable depositing surface for the double yarn and that, at the inlet side of the suction chamber, an air nozzle is provided which receives the double yarn and delivers it to the suction chamber.

In the suction chamber, the double yarn is "semirandomly" deposited in the form of loops. The air nozzle located at the inlet side has the effect that a certain connection is generated between the two yarn components because individual fiber ends projecting from the yarn components intermingle or hook into one another which significantly reduces the risk that the two yarn components shift with respect to one another inside the suction chamber.

In a further development of the invention, it is provided that the air nozzle, at the edge of the suction chamber, is arranged at a point which is opposite the Point of the edge which serves as a deflection for the running-off double yarn. As a result, the entering double yarn is largely separated from the emerging double yarn so that favorable conditions exist particularly for the emptying of the suction chamber.

In a further development of the invention, it is provided that the depositing surface is arranged diagonally with respect to the longitudinally extending axis of the suction chamber. In this case, it is advantageous for the depositing surface to have a larger distance to the air nozzle than to the deflection for the running-off double yarn. In this manner, the loops are deposited diagonally with respect to the withdrawal direction so that the emerging double yarn can be pulled out more easily from under the deposited loops.

In a further development of the invention, it is provided that the air nozzle is constructed as a twisting nozzle which is provided with a longitudinal slot. This twisting nozzle provides the double yarn with a false twist which opens up again when it emerges from the twisting nozzle. During this opening-up of the false twist, several fiber ends remain wound around both yarn components so that the two yarn components are at least somewhat connected with one another.

Other objects, advantages and novel features of the present invention will become apparent from the following detailed description of the invention when considered in conjunction with the accompanying drawings.

DETAILED DESCRIPTION OF THE DRAWINGS

Figures 1, 2:
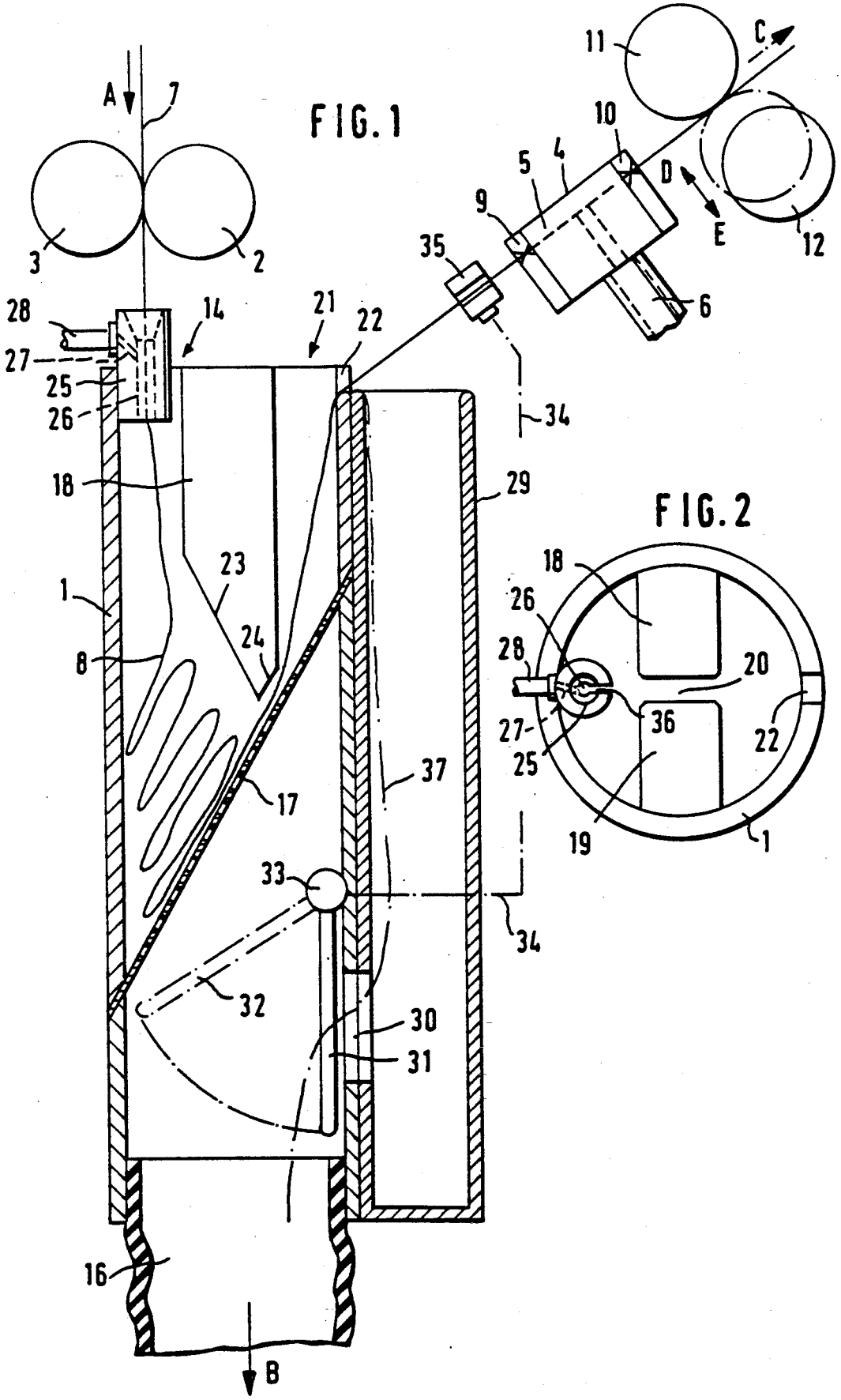
FIG. 1 is a schematic longitudinal sectional view of an arrangement for the intermediate storage constructed according to the invention.
FIG. 2 is a view from the direction of the inlet side of the arrangement according to FIG. 1.

The drawing shows only one pair of delivery rollers 2, 3 of a spinning unit which withdraws a double yarn 7 in the direction of the arrow (A) from the spinning elements and delivers it. The double yarn 7 consists of two yarn components which, in a known manner, are formed from slivers and which, in drafting units, are drawn to the desired yarn size and subsequently are prestrengthened preferably by means of pneumatic false-twisting devices. These only prestrengthened yarn components are guided together in front of the pair of delivery rollers 2, 3 so that they are located closely next to one another at a short distance and form the double yarn 7. The double yarn 7 subsequently runs to a wind-up spool which is not shown and which is driven by a wind-up device. This wind-up spool is later fed to a twisting machine by means of which the double yarn formed of only two prestrengthened yarn components is processed to a type of twisted yarn and in the process receives its final strength.

In the case of a yarn breakage, the end of the double yarn wound onto the wind-up spool is connected with a newly spun double yarn 7 delivered by the pair of delivery rollers 2, 3. This preferably takes place in a pneumatic splicing arrangement 4 having a splicing duct 5 into which the double yarn 7 coming from the pair of delivery rollers 2, 3 and the yarn end withdrawn from the wind-up spool are placed in opposite directions. The splicing arrangement 4 is equipped with a compressed-air connection 6. While the splicing operation is carried out, the two yarns placed in the splicing duct 5 are held in a clamped manner by means of clamping devices 9, 10 so that the two yarns stand still in the splicing arrangement 4. Then the clamping devices 9, 10 are opened up, after which the connected yarns are withdrawn by a pair of withdrawal rollers 11, 12. Withdrawal roller 12 can be adjusted in the direction of the arrows (D, E) so that the withdrawal can be interrupted in direction (C).

Since, during the standstill of the two yarns to be connected, the double yarn 7 continues to be delivered by the pair of delivery rollers 2, 3, it is received in the suction chamber 1 serving as the intermediate storage device. After the establishing of the yarn connection, the suction chamber 1 is emptied by the withdrawal of the connected double yarn 7 by means of the pair of withdrawal rollers 11, 12 which runs at a higher speed than the pair of delivery rollers 2, 3.

While the pair of delivery rollers 2, 3 is a component of a spinning unit, which is not shown, of a spinning machine containing a plurality of spinning units of that type, the suction chamber 1, the splicing arrangement 4 and the pair of withdrawal rollers 11, 12 are components of a servicing apparatus which can be moved along the spinning machine and, as required, can be applied to an individual spinning unit, this servicing apparatus carrying out the piecing operation in a known manner. In a known manner, this servicing apparatus has devices by means of which a yarn can be taken off the wind-up spool and can be fed to the pair of withdrawal rollers 11, 12 and to the splicing arrangement 4. Also in known manner, it has gripping elements by means of which the double yarn 7 can be picked up behind the pair of delivery rollers 2, 3 and can be applied to the splicing arrangement 4. The suction chamber 1 is brought into the area of the course of the yarn so that it can pick up the double yarn 7 delivered by the pair of delivery rollers 2, 3.

The suction chamber 1 consists of a pipe which, at its end facing away from the inlet side, is connected to a suction pipe 16 by means of which an air current is generated in the direction of the arrow (B). At its inlet side, the suction chamber 1, at its edge, is equipped with a twisting nozzle 25 which, by means of a pipe 28, is connected to a compressed-air source which is not shown. The twisting nozzle 25 has a blow opening 27 which is directed approximately tangentially to an essentially cylindrical duct 26 and has a slope in the yarn conveying direction.

As shown in FIG. 2, the twisting nozzle 25 is provided with a longitudinal slot 36 which extends along the twisting duct 26 and the feeding hopper connected in front of it.

The twisting nozzle 25 takes in the delivered double yarn 7 and delivers it into the suction chamber 1. At the point of the edge which is diametrically opposite the twisting nozzle 25, a rounded-off notch 22 is provided which serves as the deflection for the yarn to be withdrawn.

A depositing surface 17 in the form of a perforated plate is arranged in the suction chamber 1 constructed as a pipe. The depositing surface 17 is arranged at an angle diagonally in the suction chamber 1. The slope is selected such that the distance from the depositing surface 17 to the twisting nozzle 25 is larger than to the notch 22. The angle amounts to approximately 60 degrees with respect to the longitudinal axis of the suction chamber 1. The exact distance of the depositing surface 17 must be adapted to the yarn length to be stored and is expediently determined by experimenting.

As shown in FIG. 1, the double yarn 7 is deposited in the form of loops 8 on the depositing surface 17 and is held there by the suction draught.

The suction chamber 1 is subdivided into two partial chambers 14, 21 by a profiling formed by two inserts 18, 19, one partial chamber of which being assigned to the area of the twisting nozzle 25 and the other partial chamber being assigned to the notch 22 serving as the deflection. The inserts 18, 19 leave a slot 20 between them by way of which the intermediately stored yarn can be withdrawn completely. The ends 24 extend to close to the depositing surface 17 and rise, preferably by means of a slope, to the slot 20. On the side facing the partial chamber 14, the inserts 18, 19 are provided with diagonal guiding surfaces 23 so that the partial chamber 14 is widened in the area of the depositing surfaces 17.

Between the suction chamber 1 and the splicing arrangement 4, an auxiliary suction chamber 29 is arranged which by way of openings 30 below the depositing surface 17, is connected with the suction chamber 1 and thus is also connected with the suction pipe 16. These openings 30 may be blocked by a flap 31 which, by means of a drive, can be swivelled around a shaft 33 into position 32. The drive of the flap 31 is controlled by means of a yarn detector 35 connected in front of the splicing arrangement 4, which is indicated by a dash-dotted connecting line 34.

Should the yarn detector 35 determine that a yarn breakage exists, for example, as a result of an unsuccessful splicing attempt, the flap 31 is swivelled into position 32. As a result, the auxiliary suction chamber 29 is connected to the suction pipe 16, while the suction chamber 1 is closed, apart from a connection which still maintains a slight suction draft. The broken yarn 37 is then sucked into the auxiliary suction chamber 29 and subsequently into the suction pipe 16 so that the suction chamber 1 is evacuated. This has the effect that, on the one hand, the suction chamber 1 is evacuated while, on the other hand, the double yarn 7 leaving the pair of delivery rollers 2, 3 can be gripped and inserted into the splicing arrangement 4.

As a modification of the shown embodiment, it may be provided, instead of the auxiliary suction chamber 29, that the depositing surface 17 is constructed as a pivotable flap which has a drive controlled by the yarn detector 35. As a result, it is possible, in the case of a yarn breakage, to suck off and remove the yarn length located in the suction chamber 1 in the direction of the suction pipe 16.

In a further modification, it is provided that the suction chamber 1 is not formed by a round pipe but by an oval pipe, the largest dimension of which exists between the twisting nozzle 25 and the notch 22 serving as the deflection. When this largest diameter is properly dimensioned, the inserts 18, 19 are not required. These inserts 18, 19 may also be replaced by bead-type impressions of the pipe wall.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An intermediate yarn storage arrangement for accommodating the intermediate storage of a double yarn including two yarn components being delivered by a delivery device of a spinning unit during connection of the double yarn with previously spun yarn withdrawn from a wind-up spool, said intermediate yarn storage arrangement comprising:

a suction chamber having a yarn inlet opening and an air permeable yarn depositing surface, and an air nozzle provided at the yarn inlet opening immediately upstream of the suction chamber for receiving double yarn delivered by the delivery device so that said double yarn is supplied to the suction chamber through the air nozzle with said air nozzle reducing the tendency of the two yarn components shifting with respect to one another in the suction chamber.

2. An arrangement according to claim 1, wherein the air nozzle is arranged at an edge portion of the yarn inlet opening of the suction chamber at a point which is opposite a point of an edge position of the suction chamber which serves as a deflection for double yarn being withdrawn from the suction chamber.

3. An arrangement according to claim 2, wherein the suction chamber is constructed as a pipe, and wherein the air permeable depositing surface is a sieve-type depositing surface which is inserted in front of a connection to a suction pipe connected to the suction chamber pipe.

4. An arrangement according to claim 3, wherein the depositing surface is arranged diagonally with respect to the longitudinal axis of the suction chamber.

5. An arrangement according to claim 2, wherein the depositing surface is arranged diagonally with respect to the longitudinal axis of the suction chamber.

6. An arrangement according to claim 2, wherein the depositing surface has a larger distance to the air nozzle than to the deflection.

7. An arrangement according to claim 2, wherein the suction chamber is subdivided by means of profilings into a partial chamber assigned to the air nozzle and into a partial chamber assigned to the deflection, and wherein a slot is provided between the two partial chambers.

8. An arrangement according to claim 7, wherein the profilings are provided with bevelled guiding surfaces which widen the partial chamber assigned to the air nozzle.

9. An arrangement according to claim 2, wherein an auxiliary suction chamber is arranged next to the suction chamber and connecting the deflecting point, and wherein a suction effect control device is provided which is controlled by a yarn detector, and which can switch the suction from the suction chamber to the auxiliary suction chamber in dependence on the signal from the yarn detector.

10. An arrangement according to claim 2, wherein the air nozzle is constructed as a twisting nozzle which is provided with a longitudinal slot.

11. An arrangement according to claim 1, wherein the suction chamber is constructed as a pipe, and wherein the air permeable depositing surface is a sieve-type depositing surface which is inserted in front of a connection to a suction pipe connected to the suction chamber pipe.

12. An arrangement according to claim 11, wherein the depositing surface of the suction chamber is constructed as an adjustable flap to which a drive is assigned which can be controlled by a yarn detector.

13. An arrangement according to claim 1, wherein the air nozzle is constructed as a twisting nozzle which is provided with a longitudinal slot.

14. An arrangement according to claim 1, wherein the depositing surface is arranged diagonally with respect to a longitudinal axis of the suction chamber.

15. An arrangement according to claim 1, wherein the depositing surface of the suction chamber is constructed as an adjustable flap to which a drive is assigned which can be controlled by a yarn detector.

16. An arrangement according to claim 1, wherein the air nozzle is constructed as a twisting nozzle which is provided with a longitudinal slot.

* * * * *